US006921501B2

(12) United States Patent
Mathis

(10) Patent No.: US 6,921,501 B2
(45) Date of Patent: Jul. 26, 2005

(54) METHOD OF FORMING A CIRCUMFERENTIALLY CLOSED CONCRETE WALL HAVING THE SAME CROSS-SECTION OVER THE ENTIRE HEIGHT THEREOF

(75) Inventor: Hugo Mathis, Bregenz (AT)

(73) Assignee: Rund-Stahl-Bau Gesellschaftm.b.H., Fussach (AT)

( * ) Notice: Subject to any disclaimer, the term of this patent is extended or adjusted under 35 U.S.C. 154(b) by 342 days.

(21) Appl. No.: 10/288,872

(22) Filed: Nov. 6, 2002

(65) Prior Publication Data

US 2003/0089074 A1 May 15, 2003

(30) Foreign Application Priority Data

Nov. 9, 2001 (AT) ..... A 1769/2001

(51) Int. Cl.[7] ..... E04G 11/28; E04G 11/20; B28B 1/14

(52) U.S. Cl. ..... 264/33; 264/39; 264/333; 425/63; 425/64; 425/65; 425/451.9; 249/20; 249/22; 249/189; 249/190

(58) Field of Search ..... 264/33, 39, 333; 425/63, 64, 65, 451.9; 249/20, 22, 189, 190

(56) References Cited

U.S. PATENT DOCUMENTS 836,667 A * 11/1906 Burns ..... 425/65
1,478,653 A * 12/1923 Holmes ..... 249/20
3,224,065 A * 12/1965 Cheskin ..... 425/65
3,583,666 A * 6/1971 Horstketter ..... 249/10
3,588,026 A * 6/1971 Williams ..... 249/10
4,043,087 A * 8/1977 Connors ..... 52/127.3
4,147,483 A * 4/1979 Rovera et al. ..... 425/65
4,300,746 A * 11/1981 Schoen ..... 249/13
4,355,453 A * 10/1982 Pause et al. ..... 29/460
4,422,617 A * 12/1983 Gallis ..... 249/19
4,709,899 A * 12/1987 Kajioka et al. ..... 249/20
4,974,700 A * 12/1990 Gates ..... 182/128
5,088,578 A * 2/1992 Gates ..... 182/128
6,276,912 B1 * 8/2001 Rock ..... 425/63
6,770,228 B2 * 8/2004 Rock ..... 264/33

* cited by examiner

*Primary Examiner*—Michael P. Colaianni
*Assistant Examiner*—Michael I. Poe
(74) *Attorney, Agent, or Firm*—Sidley Austin Brown & Wood, LLP

(57) ABSTRACT

A method of forming a circumferentially closed wall having the same cross-section over its entire length included providing at least two circumferentially closed inner falseworks each formed of circumferentially closed inner part and a circumferentially closed climbing strip releasably securable to an upper end of the main part. A concrete wall is formed in a plurality of concrete-placing steps, with use of the inner falseworks in more than one step. In a first concrete-placing step, an initial section of a concrete wall is formed. In each subsequent concrete-placing step, a circumferentially closed concrete wall section is formed on an upper end of an already formed section of the concrete wall.

8 Claims, 6 Drawing Sheets

METHOD OF FORMING A CIRCUMFERENTIALLY CLOSED CONCRETE WALL HAVING THE SAME CROSS-SECTION OVER THE ENTIRE HEIGHT THEREOF

BACKGROUND OF THE INVENTION

1. Field of the Invention

The present invention relates to a method of erection of constructional units and, in particular, to a method of forming a circumferentially closed concrete wall having the same cross-section over its entire height in a plurality of concrete-placing steps and in which in each subsequent step, a circumferentially closed concrete wall section is formed on an upper end of an already formed concrete wall section, and at least one circumferentially closed inner falsework is used in more than one concrete-placing steps.

"The same cross-section" means the cross-section of the wall does not change its shape and size over the entire height of the wall.

2. Description of the Prior Art

Many constructional units, such as rotundas, staircases, chimneys have circumferentially closed walls.

It is known, e.g., to use, for erection of rotundas, climbing falseworks in which two circumferentially closed falsework rings are suspended on a support frame. The space of the falsework, which is limited by the rings, is filled with concrete. After the concrete hardens, the falsework rings are released, but are lifted on the support frame so high that their lower portion still remains in the region of the outer edge of the cast wall ring. Then, the rings are again secured, the concrete is poured in, and the process is repeated until the desired height is reached. In this way, in the cylindrical edifices, one wall ring is placed on another wall ring.

Another type of a climbing falsework is shown and described in U.S. Pat. No. 1,478,653. With such climbing falseworks, the use of anchors during walling is contemplated with which the falsework elements are braced. With such anchors, an upper anchor embedded during one concrete-placing step becomes a bottom anchor during another, following concrete-placing step. In each concrete-placing step, a new anchor is embedded. The falsework is then lifted when the preceding concrete wall section is tied as the wall section with its anchors has to carry the entire weight of the falsework. The falsework itself is formed of separate panels and the panel-reinforcing frames.

Conventionally, with climbing wall formation, the process is effected in following steps. First, the inner falsework, which is to be used in the next concrete-placing step, is secured to an already formed section of the concrete wall at a predetermined height and is centered. Then, embeddable into the concrete wall, components are secured to the inner falsework at respective locations. Such components are, e.g., anchors or embeddable casings for plug sockets. In case recesses should be formed in the concrete wall, e.g., for windows or doors, corresponding falsework parts for forming the recesses or openings are secured to the falsework. Then, reinforcing means for the next formed section of the wall is mounted. Portions of the reinforcing means can be connected to the inner falsework for retaining the reinforcing means in place. Occasionally, on a mounting site, reinforcing means is secured to a bottom of a formed, circumferentially closed reinforcing means holder, is lifted with a lifting jack, and is placed, over the inner falsework secured to the wall, on a wall top. This, however, is only then possible when no opening-formed elements are attached to the inner falsework which, otherwise, would interfere with placing of the reinforcing means holder. Then, an outer falsework is attached and connected with the inner falsework for forming a circumferentially closed section of the wall, with concrete being poured into the space between the outer and inner falseworks.

An object of the invention is to provide a particularly effective and economical method of forming a circumferentially closed concrete wall.

SUMMARY OF THE INVENTION

This and other objects of the present invention, which will become apparent hereinafter, are achieved by providing a method of forming circumferentially closed walls having a uniform cross-section over entire height of the wall and in which, there are provided at least two circumferentially closed inner falseworks having a same cross-section of a boarding and formed each of a circumferentially closed main part and a circumferentially closed climbing strip releasably securable to an upper end of the main part and forming a part of the boarding. The concrete wall is formed in a plurality of concrete-placing steps, with use of the at least two inner falseworks in more than one steps, where in each subsequent concrete-placing step, a circumferentially closed concrete wall section is formed on an upper end of an already formed section of the concrete wall. During effecting, at least one concrete-placing step, one of the at least two inner falseworks, which is used in the at least one concrete-placing step and which was lifted off a mounting site, is placed on the climbing strip which is secured on the concrete wall section formed in a previous concrete-placing step and which forms part of another of the at least two falseworks that was used in the previous step. Before the lifting of the one of the at least two inner falseworks off a mounting site, appropriate, for the at least one concrete-placing step, reinforcing means are secured on an outer side of the one of the at least two inner falseworks.

With respect to the inner falseworks, "the same cross-section" means that the cross-sectional surfaces of the falsework boarding, i.e., the surfaces, which are surrounded by the circumferentially closed profiles of the boarding, in cross-section, have the same shape and size.

With the inventive method, the inner falseworks are pre-assembled on a mounting site, with the reinforcing means being provided on the outer surfaces of the inner falseworks. The mounting process can take place while the previous concrete-placing step is effected or during hardening of concrete poured in the previous step. Then, the inner falsework is lifted, together with the attached thereto, reinforcing means, and is placed on the climbing strip that was left on the already formed wall section. The climbing strip has means that provides for centering of the inner falsework, which permits to eliminate additional step associated with a need to center the inner falsework. Thus, the inner falsework, together with the reinforcing means, occupies a predetermined position as soon as it is placed on the climbing strip.

The inventive method permits to substantially reduce the time necessary for erection of a circumferentially closed wall. The use of at least two inner falseworks, which are used in several steps, permits to prepare one of the falseworks at a mounting site for a next concrete-placing step, while another is already used for forming a section of the concrete wall. For further reduction of the erection time, three or more inner falseworks having the same cross-section can be used. That would permit to prepare simultaneously, at different mounting sites, several inner falseworks for several concrete wall sections.

Advantageously, if necessary, the falsework parts for forming openings in a concrete wall can also be attached to the inner falsework at a mounting site. The same applies to embedded elements of the concrete wall. The embedded elements can be attached either to the falsework or to the reinforcing means.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
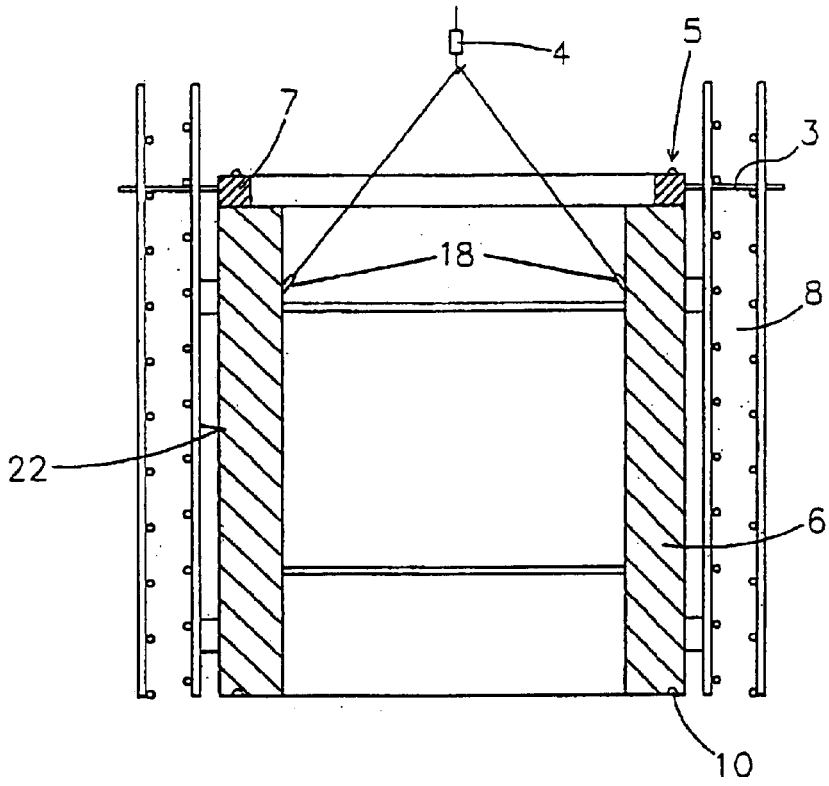
FIG. 1 a vertical cross-sectional view illustrating a first phase of a method according to the present invention of erection of a circumferentially closed wall.
Figure 1:
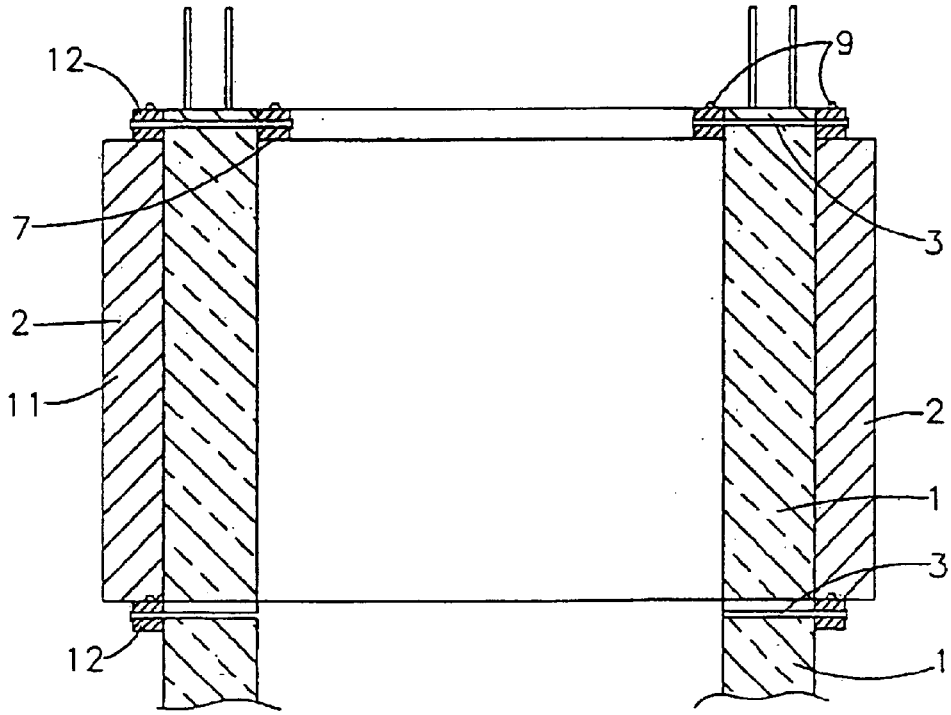

FIG. 1 shows a partially finished, circumferentially closed constructional unit obtained in a first phase of a method according to the present invention. In the previous concrete-placing steps, several, circumferentially closed sections 1 of a concrete wall were formed between which respective concreting joints 21 are visible. An outer falsework 2 is placed on the last-formed section 1 of the concrete wall. For securing the outer falsework 2 to the concrete wall, a plurality of anchors 3 are embedded into the concrete wall along its circumference in several locations in per se known manner. Anchors 3 are standard constructional anchors. The anchors 3 can be provided with an inner thread accessible from both outer side and inner side of the concrete wall and into which screw bolt can be screwed in.

With a lifting jack 4, a preformed inner falsework 5 is lifted up to the upper end of the formed portion of the constructional unit. The inner falsework 5 includes a main part 6 and a climbing strip 7 provided on the upper end of the main part 6 and connected therewith, e.g., by a threaded connection. In the mounted condition, both the main part 6 and the climbing strip 7 are circumferentially closed, with their outer sides forming the boarding 22. On the outer side of the inner falsework 5, there is provided reinforcing means that is carried by the inner falsework 5. The reinforcing means 8 for the next to-be-erected circumferentially closed section of the concrete wall is provided before lifting of the inner falseworks 5 on a mounting site and is connected with the inner falsework 5. Later, elements of the concrete wall are provided on the reinforcing means 8, which elements can include, e.g., anchors 3 and other elements contemplated in the concrete wall. Later, elements of the concrete wall are provided on the reinforcing means 8, which elements can include, e.g., anchors 3 and other elements contemplated in the concrete wall. Later, falsework sections for forming openings in the to-be-formed section of the concrete wall can be provided on the inner falsework 5.

In the previous concrete-placing step, on the inner side of the concrete wall, a climbing strip 7 of the inner falsework 5, which was used in this previous step, was secured, by using the imbedded anchors 3, with screw bolts screwed into the anchors 3 and projecting through the openings in the climbing strip 7. Before securing the climbing strip 7, the main part 6 of the inner falsework 5, which was used in this previous step, has already been lifted off the concrete wall. The lifted inner falsework 5 is then placed, with the lifting jack 4 onto the climbing strip 7 which was secured to the concrete wall in the previous concrete-placing step. For centering and the alignment of the inner falsework 5 with the climbing strip 7 secured to the concrete wall, there are provided, on the upper surface of the climbing strip 7, cones 9 insertable in depressions 10 provided on the inner side of the main part 6. The depressions 10 have a shape corresponding to that of cones 9. As a result, the inner falsework, which sites on the climbing strip 7, is precisely aligned so that further aligning and leveling steps for the inner falsework 5 are eliminated.

Instead of cones 9, other elements can be used for centering the inner falsework 5' on the climbing strip 7 secured on the concrete walls. E.g., guide sheets, which project from the climbing strip 7 upward and downward therefrom, can be used. To this end, the guide sheets can be provided with run-on slopes for the main part 6 of the inner falsework 5 placed on the climbing strip 4. The width of the climbing strip 7 can be smaller than that of the main part 6, as shown in the figures. The width of a climbing strip can also be the same as that of the main part and (theoretically) it can be greater than that of the main part. The main part 6, can be formed as a falsework frame. The climbing strip 7 can be formed, e.g., by a U-shaped profile, with its opening side facing downward.

Figure 2:
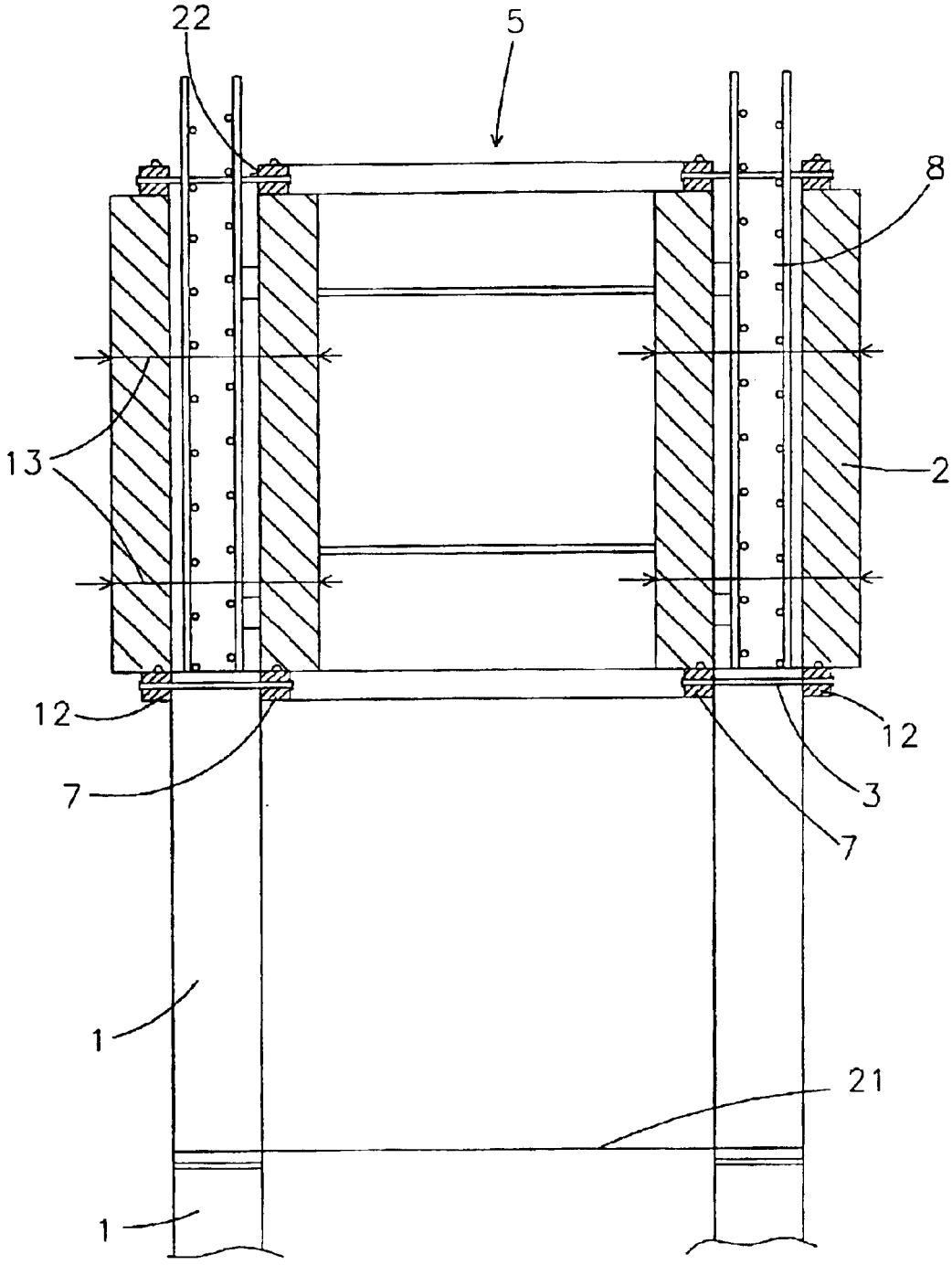
FIG. 2 a vertical cross-sectional view illustrating a second phase of a method according to the present invention of erection of a circumferentially closed wall.

FIG. 2 shows the inner falsework 5 being placed on the climbing strip 7, which is secured to the concrete wall, and, preferably, attached to the climbing strip 7 with screw means. The reinforcing means 8, which is attached to the inner falsework 5, is already in the correct position. Then, in the second phase shown in FIG. 2, the outer falsework 2 is mounted. The outer falsework 2 is formed of a main part 11 and climbing strips 12 securable to upper and lower ends of the outer falsework 2. From the position shown in FIG. 1, the main part 11 is lifted from the concrete wall, together with the climbing strip 12 secured to the lower end of the main part 11. After the outer falsework 2 is lifted, the climbing strip 12, which is secured to the lower end of the main part 11, is lifted therefrom and is secured to the upper end of the main part. As a result, the main part 11 is placed, together with the climbing strip 12, secured to its upper end, onto the climbing strip 12 that remained on the concrete wall. The outer falsework 2 is then screwed to the climbing strip 12, which remained on the concrete wall, and is connected with the inner falsework in a conventional manner, as shown with lines 13 in FIG. 2.

Figure 3:
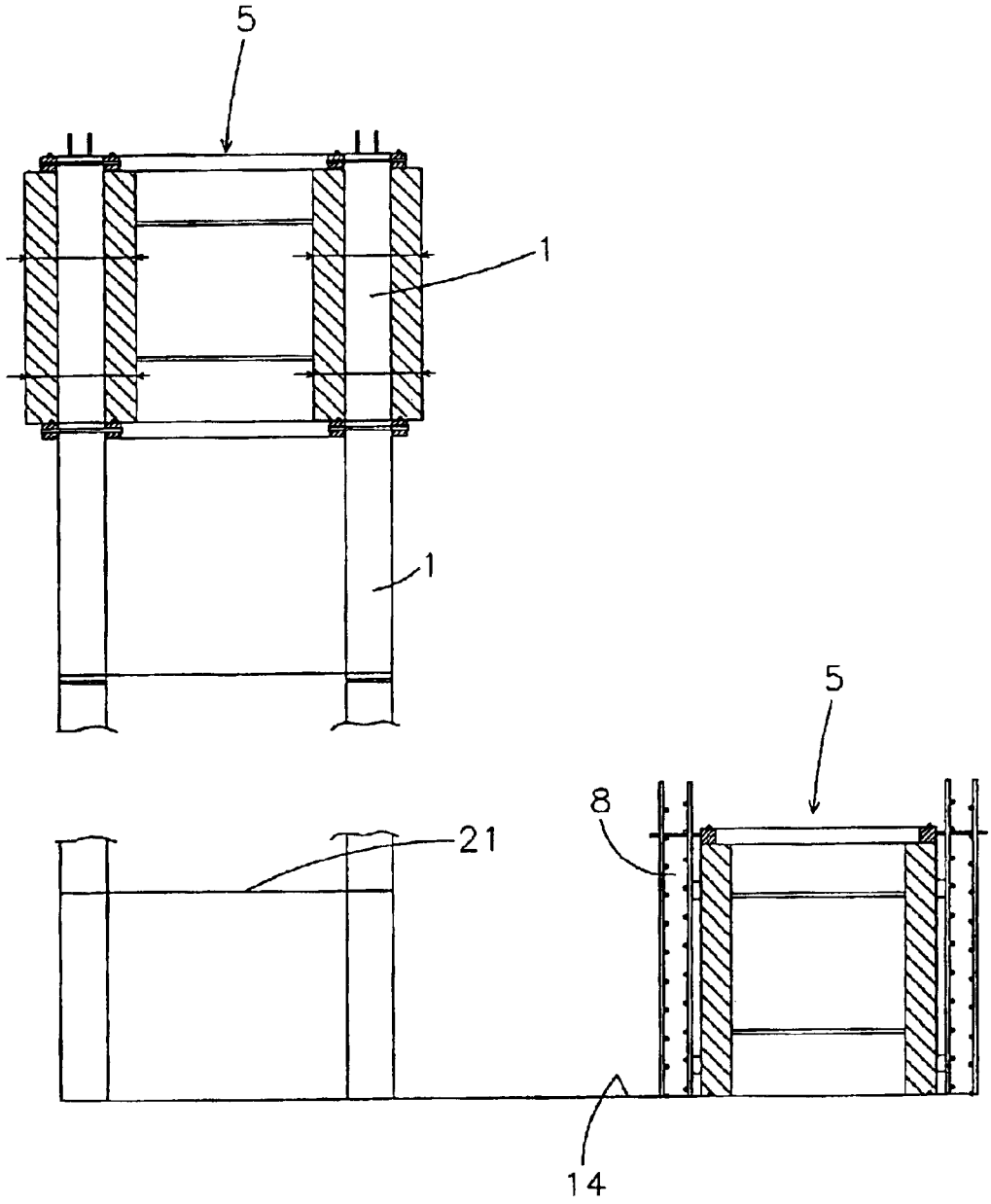
FIG. 3 a vertical cross-sectional view illustrating a third phase of a method according to the present invention of erection of a circumferentially closed wall.

In the next step, the space between the outer falsework 2 and the inner falsework 5 is filled with concrete up to the upper edges of the climbing strips 7, 12. This phase is shown in FIG. 3. During pouring of the concrete and its solidification, already, the inner falsework 5 can be prepared for the next concrete-placing step on a mounting site 14 which, advantageously, is provided on the floor. Here again, reinforcing means 8 is secured to the outer side of the inner falsework 5, together with other embedded components contemplated in the concrete wall. For saving time, during securing of the reinforcing means 8 to the inner falsework 5, assembly works can be conducted on several inner falseworks. Thereby, immediately after the solidification or hardening of the concrete of one section of the wall, a completely assembled inner falsework 5 with reinforcing means 8 is available for the next section.

Figure 4:
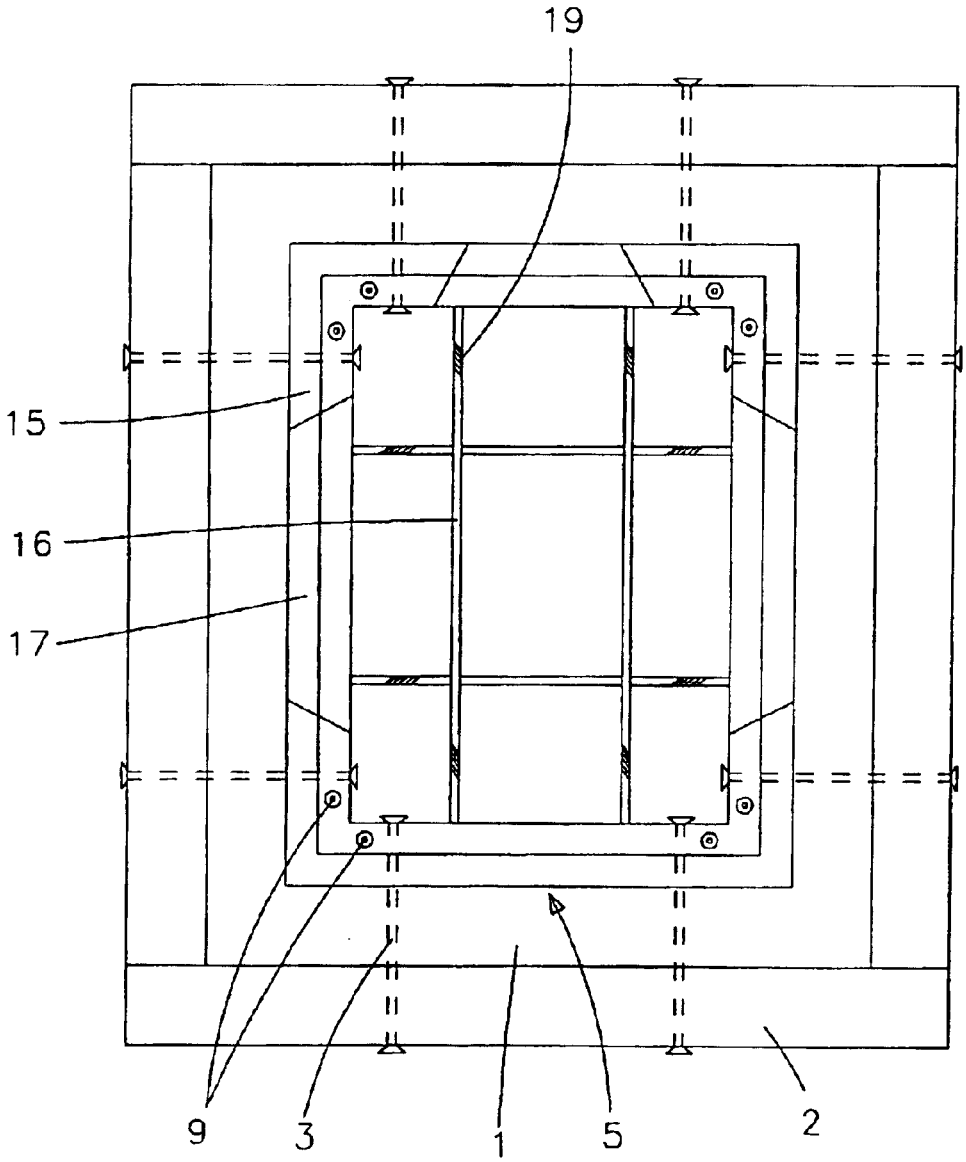
FIG. 4 a schematic plan view of the constructional unit in its third phase according to FIG. 3 (without reinforcing rods projecting from a wall top)

For lifting of the inner falseworks 5 off the wall after a concretization of a wall section, the falsework is formed of several, secured, by screws, one above the other circumferential segments having a shape shown, e.g., in FIG. 4. There are provided here four corner segments 15 and four middle segments 17 connected with each other by tie rods 16.

Figure 5:
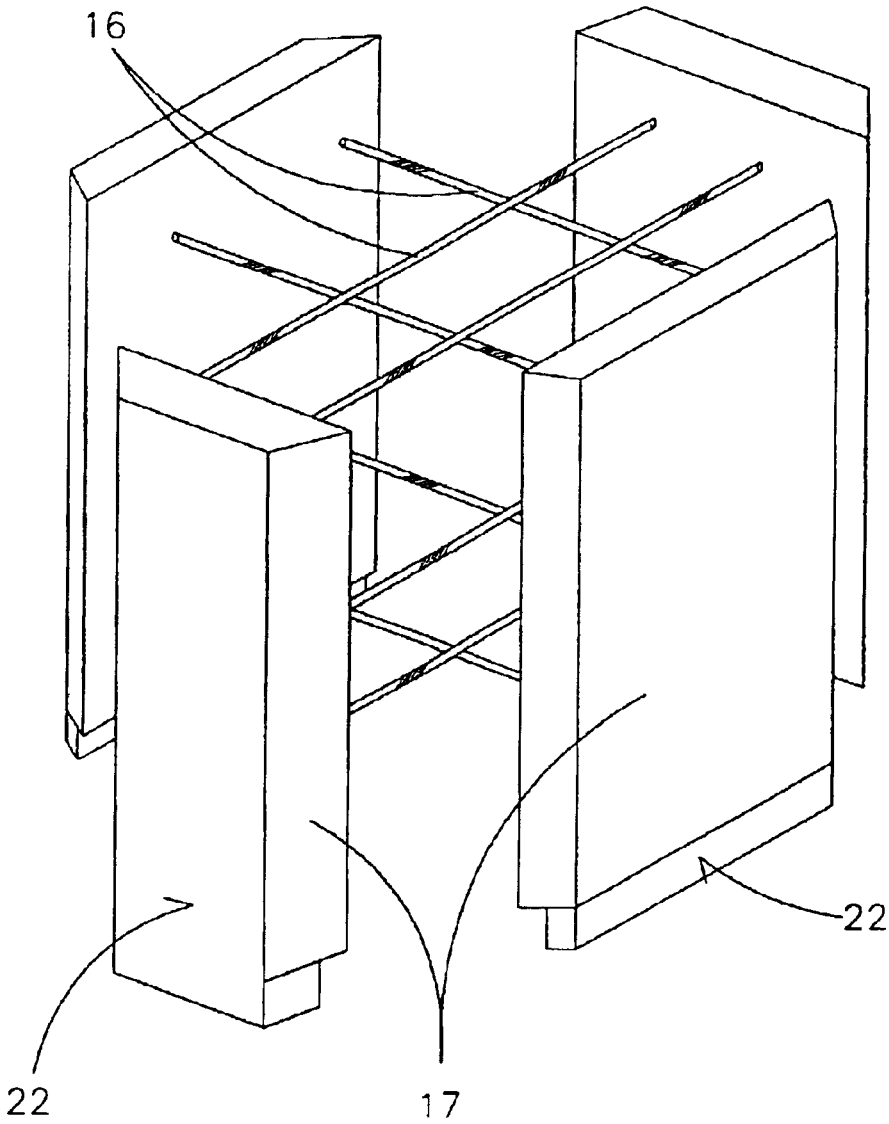
FIG. 5 a schematic perspective view of separate central segments of an inner falsework.

For lifting the inner falsework 5, the connected with each other, middle sections 17 are hanged on the lifting jack 4 with attachment eyelets 18 (see FIG. 1), and the screw connection between the middle segments 17 and the corner segments 15 is released. The tie rods 16 includes screwed into each other sections, e.g., a middle section with inner threads provided at its opposite ends and into which side sections are screwed with their outer threads. The threaded connections of the tie rods are shown in FIG. 4 with a reference number 19. By rotation of the middle sections of the tie rods 16, the middle segments 17 are connected with each other. Before that, the connections between the middle segments 17 and corresponding segments of the similar divided climbing strip 7, which is provided at the upper end of the main part 6, is released. The segments of the lower climbing strip, which are secured at the lower end of the middle segments 17, remain connected with the middle segments, as shown in FIG. 5. The middle segments 17, together with the segments of the climbing strip 7 which are secured at the lower end, are lifted off the formed section of the constructional unit. Further, the corner segments 15 and corresponding segments of the lower climbing strip 7 which are connected with the segments 15, also can be lifted off the concrete wall, and a condition, which is shown in FIG. 1, is again attained.

For lifting of the inner falsework, the segments can be distributed in the circumferential direction in a different manner.

Figure 6:
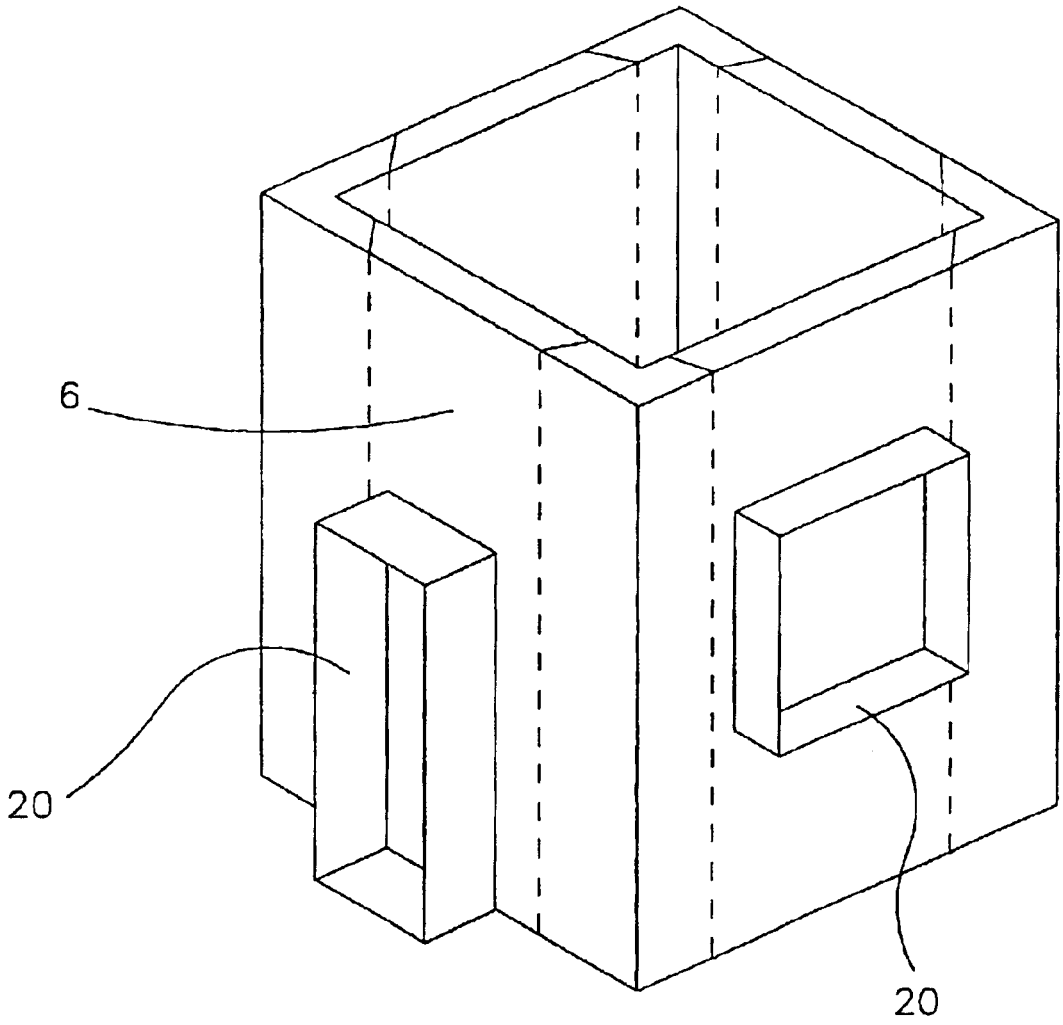
FIG. 6 a schematic perspective view of an inner falsework with elements for forming openings in a concrete wall.

FIG. 6 shows the main part 6 of the inner falsework, together with falsework sections 20 for forming opening in a respective section of the concrete wall.

Instead of the shown in the drawings, square ground plan, the constructional unit can have other circumferentially closed ground plans, e.g., a rectangular, polygonal, or circular ground plan.

The outer falsework can be formed differently than shown in the drawings. E.g., it can be formed as an integral part (without climbing strip being secured to the top and the bottom of the main part). Also, the heights of an outer falsework and an inner falsework can be different.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A method of forming a circumferentially closed concrete wall having a same cross-section over an entire height thereof, comprising the steps of providing at least two circumferentially closed inner falseworks having a same cross-section of a boarding and formed each of a circumferentially closed main part and a circumferentially closed climbing strip releasably securable to an upper end of the main part and forming a part of the boarding; and forming the concrete wall in a plurality of concrete-placing steps, with use of the at least two inner falseworks in more than one of the steps, wherein a first concrete-placing step, an initial section of a concrete wall is formed, wherein in each subsequent concrete-placing step, a circumferentially closed concrete wall section is formed on an upper end of an already formed section of the concrete wall, wherein during effecting at least one concrete-placing step, one of the at least two inner falseworks, which is used in the at least one concrete-placing step and which was lifted off a mounting site, is placed on the climbing strip which is secured on the concrete wall section formed in a previous concrete-placing step and which forms part of another of the at least two falseworks that was used in the previous step, and wherein before the lifting of the one of at least two inner falseworks off a mounting site appropriate, for the at least one concrete-placing step, reinforcing means are secured on an outer side of the one of the at least two inner falseworks.

2. A method as set forth in claim 1, wherein before the lifting of the one of the at least two inner falseworks off the mounting site, falsework sections for forming openings in the concrete wall section, which is formed in the at least one concrete-placing step, are secured to the one of the at least two inner falseworks.

3. A method as set forth in claim 1, wherein the one of the at least two inner falsework is secured to the climbing strip, which is attached to the previously formed concrete wall section, with screw means.

4. A method as set forth in claim 1, wherein the main part and the climbing strip of each of the at least two inner falseworks are divided, in a circumferential direction, in a plurality of segments.

5. A method as set forth in claim 1, wherein before the lifting of the one of the at least two inner falseworks off the mounting site, elements embeddable into the concrete wall are attached to the one of the at least two inner falseworks.

6. A method as set forth in claim 5, wherein the embeddable elements include anchors attachable to at least one of the reinforcing means and the one of the at least two inner falseworks.

7. A method as set forth in claim 1, wherein the climbing strip of the another of the at least two inner falseworks is provided with means for centering the one of the at least two inner falseworks when it is placed on the climbing strip.

8. A method as set forth in claim 7, wherein the centering means comprises cones.

* * * * *